US009882284B2

(12) United States Patent
Eom et al.

(10) Patent No.: US 9,882,284 B2
(45) Date of Patent: Jan. 30, 2018

(54) ANTENNA DEVICE OF MOBILE TERMINAL

(71) Applicant: Samsung Electronics Co. Ltd., Suwon-si, Gyeonggi-do (KR)

(72) Inventors: Sangjin Eom, Suwon-si (KR); Jaehee Kim, Suwon-si (KR); Sukho Kim, Seongnam-si (KR); Haeyeon Kim, Suwon-si (KR); Jinkyu Bang, Suwon-si (KR); Joonho Byun, Seongnam-si (KR); Kyungmoon Seol, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 855 days.

(21) Appl. No.: 13/846,011

(22) Filed: Mar. 18, 2013

(65) Prior Publication Data

US 2013/0257662 A1 Oct. 3, 2013

(30) Foreign Application Priority Data

Mar. 29, 2012 (KR) ..... 10-2012-0032181

(51) Int. Cl.
*H01Q 13/10* (2006.01)
*H01Q 1/24* (2006.01)

(52) U.S. Cl.
CPC ..... *H01Q 13/10* (2013.01); *H01Q 1/243* (2013.01)

(58) Field of Classification Search
CPC ..... H01Q 13/10
USPC ..... 343/702
See application file for complete search history.

(56) References Cited

U.S. PATENT DOCUMENTS

| | | | | |
|---|---|---|---|---|
| 6,234,593 | B1 * | 5/2001 | Chen | G06F 1/181 312/223.2 |
| 7,551,142 | B1 * | 6/2009 | Zhang et al. | 343/702 |
| 8,432,321 | B2 | 4/2013 | Arkko et al. | |
| 2002/0053991 | A1 * | 5/2002 | Lindell | H01Q 1/243 343/702 |
| 2004/0178960 | A1 | 9/2004 | Sun | |
| 2008/0165065 | A1 | 7/2008 | Hill et al. | |
| 2008/0316115 | A1 * | 12/2008 | Hill | H01Q 1/243 343/702 |
| 2009/0153407 | A1 | 6/2009 | Zhang et al. | |
| 2011/0001673 | A1 * | 1/2011 | You et al. | 343/702 |
| 2012/0313834 | A1 * | 12/2012 | Eom | H01Q 1/243 343/787 |

FOREIGN PATENT DOCUMENTS

| | | | |
|---|---|---|---|
| CN | 1549391 | A | 11/2004 |
| CN | 101641826 | A | 2/2010 |
| CN | 102227036 | A | 10/2011 |

(Continued)

*Primary Examiner* — Dameon E Levi
*Assistant Examiner* — Walter Davis
(74) *Attorney, Agent, or Firm* — Jefferson IP Law, LLP

(57) ABSTRACT

An antenna device of a mobile terminal for securing a performance of an antenna of the mobile terminal having a case of a metal material is provided. The antenna device of the mobile terminal includes an antenna module for radiating electric waves, and a case for forming an external form of the mobile terminal, made of a metal material, having a slot in a portion of the metal material, and electrically connected to each of the antenna module and a ground of the mobile terminal, and for operating as a radiator through the slot.

14 Claims, 14 Drawing Sheets

(56) References Cited

FOREIGN PATENT DOCUMENTS

| | | | | | |
|---|---|---|---|---|---|
| EP | 0272145 | A2 | | 6/1988 | |
| EP | 0851530 | A2 | * | 7/1998 | ..... H01Q 1/243 |
| EP | 0851530 | A3 | * | 7/2000 | ..... H01Q 1/243 |
| EP | 2117074 | A1 | | 11/2009 | |
| KR | 20-2010-0002855 | U | | 3/2010 | |
| TW | 201140931 | A | | 11/2011 | |

* cited by examiner

ANTENNA DEVICE OF MOBILE TERMINAL

PRIORITY

This application claims the benefit under 35 U.S.C. § 119(a) of a Korean patent application filed on Mar. 29, 2012 in the Korean Intellectual Property Office and assigned Serial No. 10-2012-0032181, the entire disclosure of which is hereby incorporated by reference.

BACKGROUND OF THE INVENTION

1. Field of the Invention

The present invention relates to an antenna device of a mobile terminal. More particularly, the present invention relates to an antenna device of a mobile terminal for securing a performance of an antenna of the mobile terminal having a case constructed using a metal material.

2. Description of the Related Art

Wireless communication technologies allow for various kinds of data, such as voice data, image data, and picture data, to be easily transferred and shared. While such wireless communication technologies are rapidly developing, the kinds of information being communicated are becoming increasingly varied, and communication is being performed at higher rates of speed.

A trend in mobile terminals is to have a slim shape and an enhanced external appearance. Further, the mobile terminal has evolved to become a complex terminal for providing various functions according to a trend of digital convergence. For example, the mobile terminal provides a service using a communication function such as digital broadcasting reception, Global Positioning System (GPS), Bluetooth, Radio Frequency Identification (RFID), and mobile commerce. In order to provide such services, the mobile terminal includes at least one antenna. An antenna is a device for efficiently radiating electric waves into free space or efficiently receiving electric waves from free space in order to perform wireless communication.

Mobile terminals should have a plurality of antennas for various services, for example, position detection, wireless Internet, and a roaming service for use in a foreign country. An antenna performance is generally proportional to a size of the antenna. Since mobile terminals now have a slim shape according to a recent trend, a problem exists in that a strength of a case of the mobile terminal is weakened.

In order to provide deluxe and elegant feelings of a metal material while addressing a strength problem of the case, mobile terminals are increasingly being made of a metal material. However, when the case of the mobile terminals is constructed using a metal material, this is a major cause for a deterioration in antenna performance, particularly, a radiation performance of an antenna, which is an important element of wireless communication.

In addition, for mobile terminals having a slim shape, a mounting space of the antenna may be insufficient when the case of the mobile terminals is constructed using a metal material, and thereby a radiation performance of the antenna may be deteriorated.

Therefore, a need exists for a technique for an antenna device of a mobile terminal to secure radiation performance in a mobile terminal having a metal case.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide an antenna device of a mobile terminal for securing a radiation performance in a mobile terminal having a metal case.

Another aspect of the present invention further is to provide an antenna device using a metal case, for example a rear metal case as a radiator. Here, when a surface formed as a screen is referred to as a front surface, a rear metal case indicates a case formed in a surface, i.e., a rear surface opposite to the front surface.

In accordance with an aspect of the present invention, an antenna device of a mobile terminal is provided. The antenna device includes an antenna module for radiating electric waves, and a case for forming an external form of the mobile terminal, made of a metal material, having a slot in a portion of the metal material, and electrically connected to each of the antenna module and a ground of the mobile terminal, and for operating as a radiator through the slot.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the following description, a radiation performance indicates a transmitting and receiving ability of an antenna device. That is, a radiation performance indicates an ability in which an antenna device efficiently receives a signal transmitted by other terminals and an ability in which the antenna device efficiently transmits a signal into free space.

Figure 1:
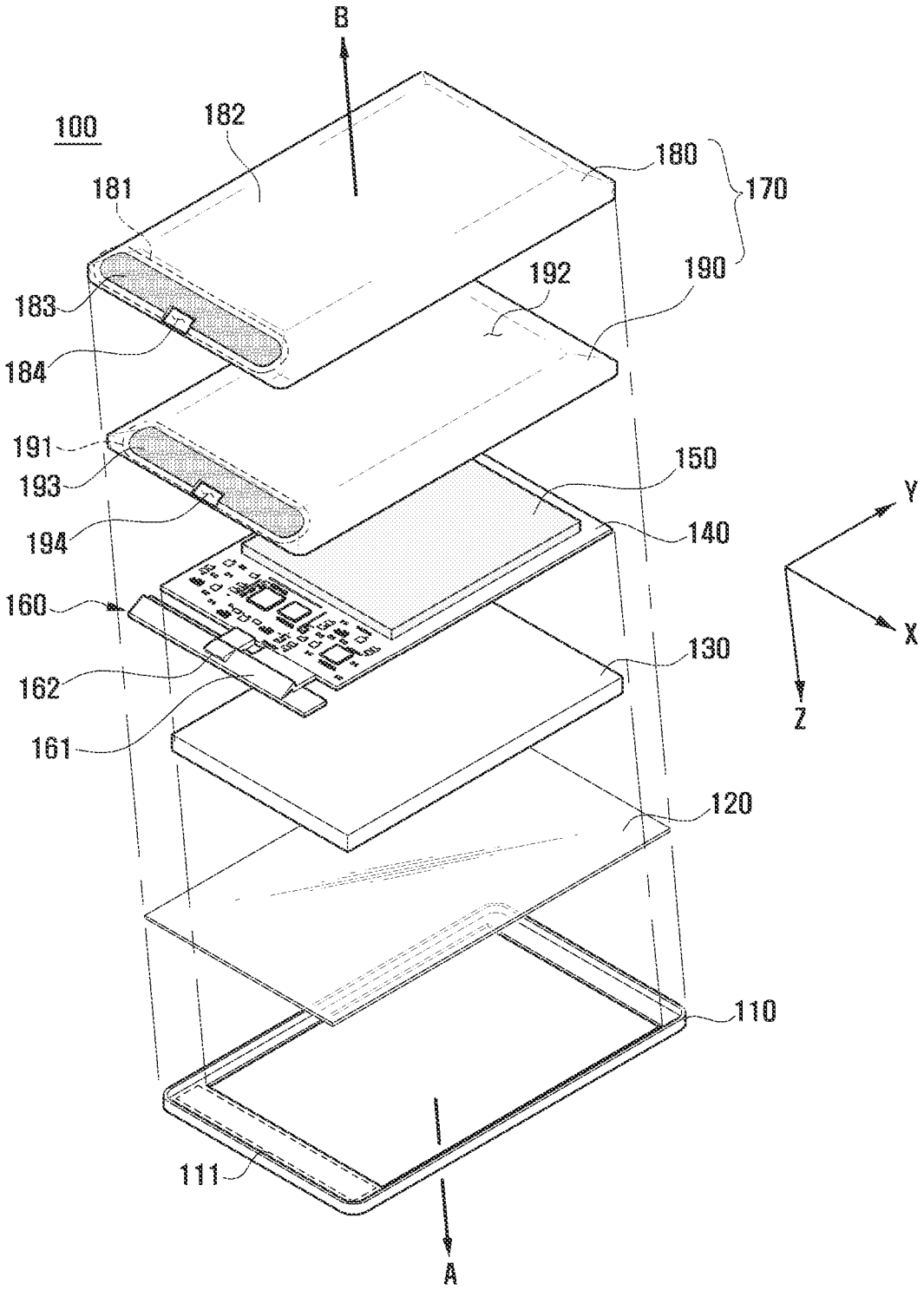
FIG. 1 is an exploded perspective view illustrating a mobile terminal according to an exemplary embodiment of the present invention.
Figure 2:
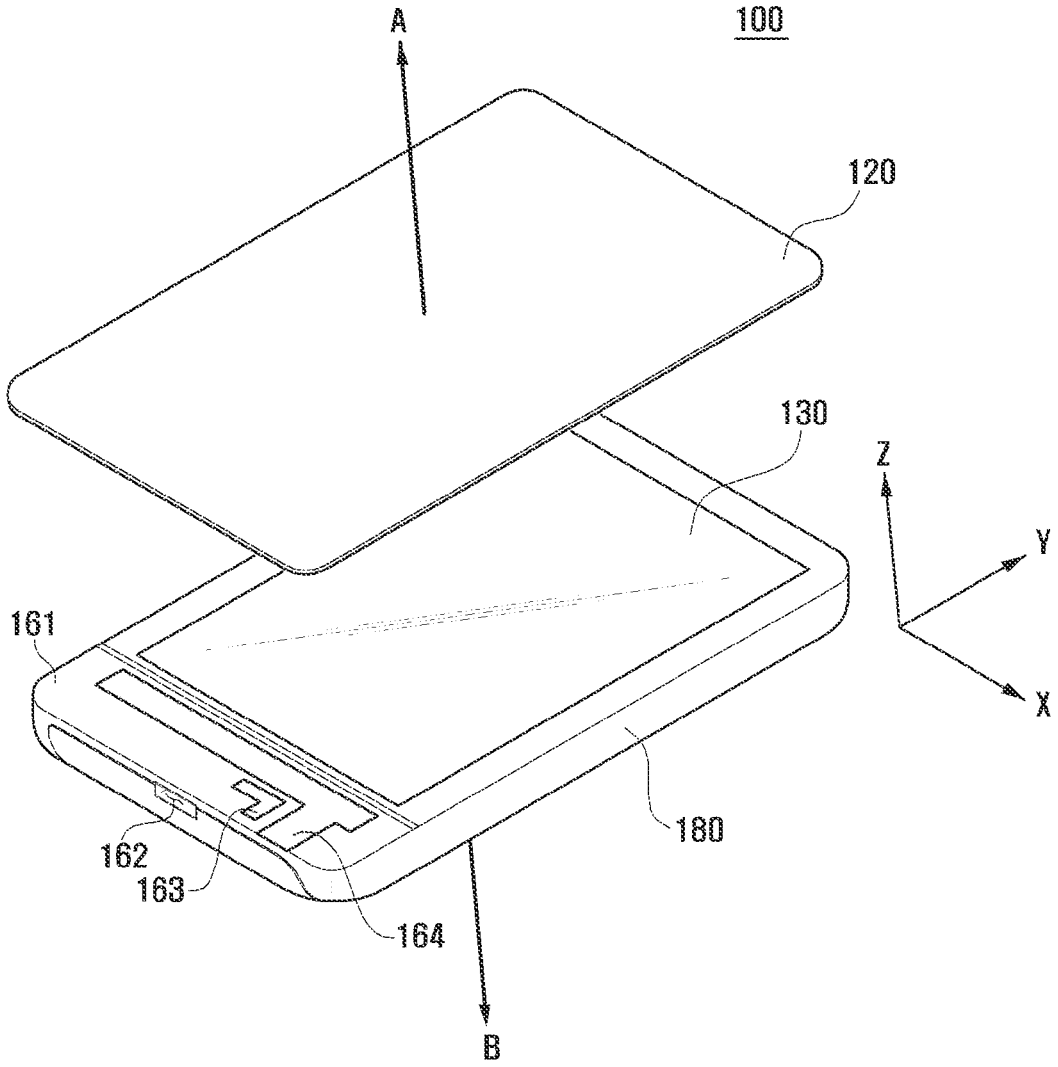
FIG. 2 is a perspective view illustrating a mobile terminal in which a front case is removed and in which a Touch Screen Panel (TSP) is separated according to an exemplary embodiment of the present invention.
Figure 3:
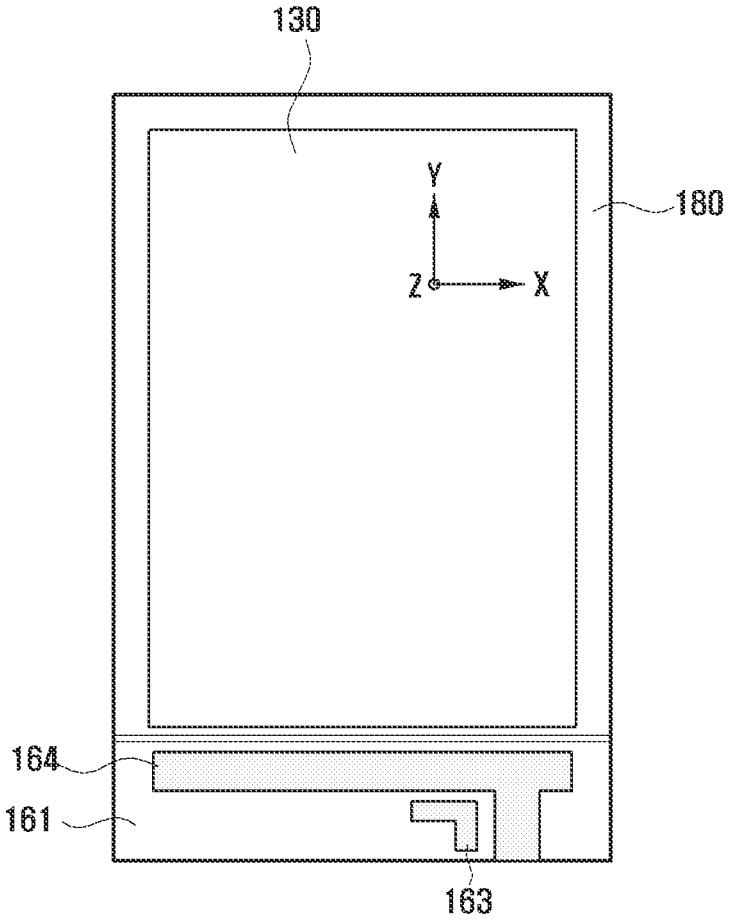
FIG. 3 is a front view illustrating a mobile terminal in which a front case and a TSP are removed according to an exemplary embodiment of the present invention.
Figure 4:
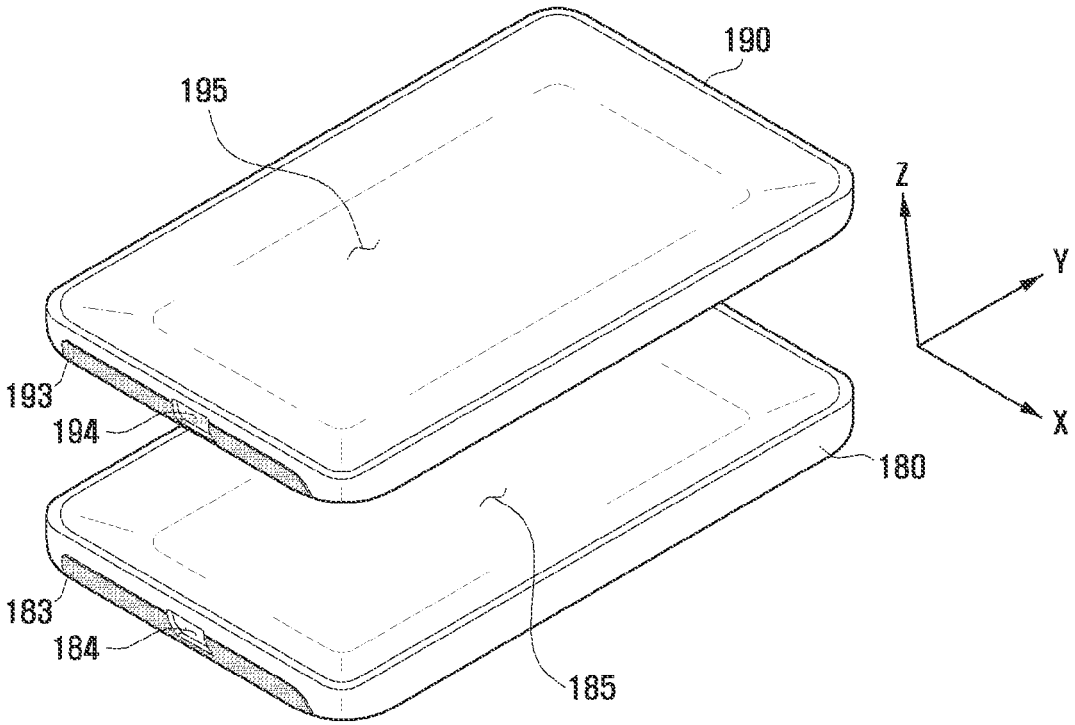
FIG. 4 is a perspective view illustrating a rear metal case in the mobile terminal of FIG. 1 according to an exemplary embodiment of the present invention.
Figure 5:
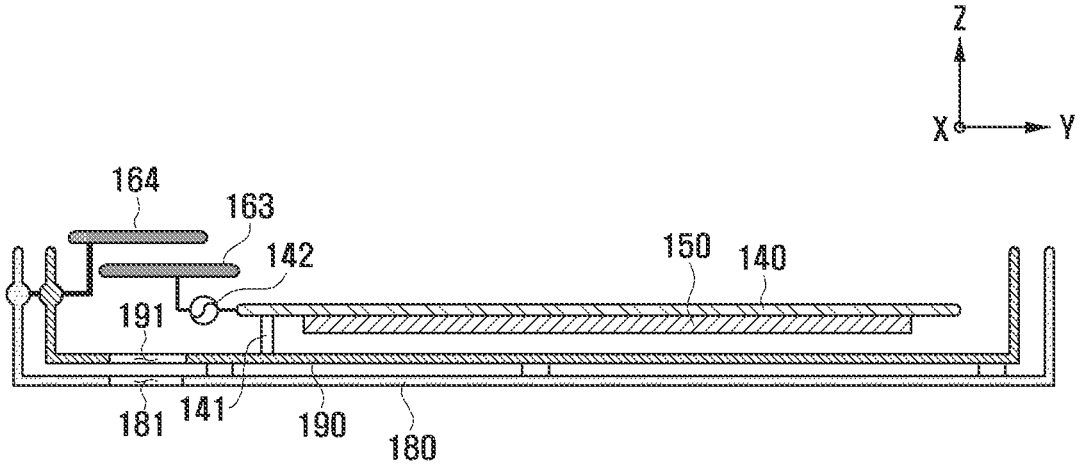
FIG. 5 is a cross-sectional view illustrating the mobile terminal of FIG. 1 according to an exemplary embodiment of the present invention.

FIG. 1 is an exploded perspective view illustrating a mobile terminal according to an exemplary embodiment of the present invention. FIG. 2 is a perspective view illustrating a mobile terminal in which a front case is removed and in which a Touch Screen Panel (TSP) is separated according to an exemplary embodiment of the present invention. FIG. 3 is a front view illustrating a mobile terminal in which a front case and a TSP are removed according to an exemplary embodiment of the present invention. FIG. 4 is a perspective view illustrating a rear metal case in the mobile terminal of FIG. 1 according to an exemplary embodiment of the present invention. FIG. 5 is a cross-sectional view illustrating the mobile terminal of FIG. 1 according to an exemplary embodiment of the present invention.

Referring to FIGS. 1 to 5, a mobile terminal 100 according to an exemplary embodiment of the present invention includes a front case 110, a touch screen panel 120, a display panel 130, a circuit board 140, a battery 150, an antenna module 160, and a rear case 170.

The rear case 170 forms an external form of the mobile terminal 100 together with the touch screen panel 120 and the front case 110. The rear case 170 protects internal constituent elements from an external impact. The rear case 170 may be made entirely of a metal material (e.g., aluminum, Steel Use Stainless (SUS), etc.).

A metal material used to construct the rear case 170 is not limited to a specific metal and may be any metal that can perform a function of a radiator. However, it is not necessary that the entire rear case 170 be constructed using a metal material. For example, the rear case 170 may include a metal material and a non-metal material (e.g., plastic). Further, as shown in FIGS. 1 and 2, the rear case 170 may include a side surface of the mobile terminal 100. Alternatively, the front case 110 may include a side surface. Further, a side case may separately exist.

The rear case 170 may include an external case 180 viewed from the outside and an internal case 190 viewed by removing the external case 180. Referring to FIG. 4, the external case 180 has housing space 185 for housing the internal case 190.

In order to replace the battery 150, the external case 180 may be separated from the mobile terminal 100 and may be recoupled to the mobile terminal 100. For example, the external case 180 functions as a battery cover for replacing the battery. A structure for such separation and recoupling may be any of various structures capable of enabling separation and recoupling. Since structures for separation and recoupling employ a well-known technology, a detailed description thereof will be omitted herein. In a mobile terminal with a built-in battery, the external case 180 has a structure that cannot be easily separated by a user from the mobile terminal 100. For example, the external case 180 may be coupled to the mobile terminal 100 by at least one of a screw, retaining tabs, and glue.

The external case 180 may be entirely made of a metal material and is electrically connected (or coupled) to the antenna module 160, and in order to be used as a radiator of the antenna module 160, the external case 180 has a slot 181. The antenna module 160 according to the present exemplary embodiment radiates electric waves in a front direction A. Further, the antenna module 160 is electrically connected (or coupled) to the external case 180 to radiate electric waves in a rear direction B through a slot 181. That is, the antenna module 160 radiates electric waves using the external case 180 in which the slot 181 is formed as one radiator. Here, as shown in FIGS. 1 and 2, the front direction A indicates the side corresponding to the front case 110, and the rear direction B indicates the side corresponding to the rear case 170.

The slot 181 is formed at an edge of the external case 180 in consideration of a design and a position at which the antenna module 160 is installed, as shown in FIG. 1. The slot 181 is not limited to the position shown in FIG. 1 and may be formed at anyplace. For example, in FIG. 1, the slot 181 is installed in a lower end portion of the rear case 170, but may be formed in an upper end portion of the rear case 170, and the center, a right side surface, or a left side surface of the external case 180.

The slot 181 may have a linear form, as shown in FIG. 1, but a form of the slot 181 is not limited thereto. When a radiation performance can be secured, the slot 181 can have any form, for example, a cross form. Further, a form of the slot 181 may be an image, a symbol, or a character form representing a product logo. In FIG. 1, the slot 181 is illustrated as one, but a plurality of slots may be formed.

In order to prevent a foreign substance from being injected into the mobile terminal 100 through the slot 181, a non-metal material may be filled in the slot 181. That is, the external case 180 includes a metal portion 182 in which the slot 181 is formed and a non-metal portion 183 installed in the slot 181.

The non-metal portion 183 may be formed by injection molding, for example, plastic to correspond to a shape of the slot 181. The non-metal portion 183 injection-molded in this way is installed in the slot 181 to form an external case 180 together with the metal portion 182.

A material of the non-metal portion 183 is not limited to a specific non-metal and may be any material through which electric waves may pass. Further, a method of manufacturing the non-metal portion 183 is not limited to injection molding. Further, in order to unify a color, a color of the non-metal portion 183 may be the same as the color of the metal portion 182. For example, when the color of the non-metal portion 183 is the same as that of a product logo, the color of the non-metal portion 183 may be different from that of the metal portion 182.

The internal case 190 is housed in the housing space 185 of the external case 180. As shown in FIG. 4, the internal case 190 includes housing space 195 for receiving the touch screen panel 120, the display panel 130, the circuit board 140, the battery 150, and the antenna module 160.

In order to replace the battery 150, the internal case 190 may be separated from the mobile terminal 100 and recoupled to the mobile terminal 100. The internal case 190 may be entirely made of a metal material and is electrically connected (or coupled) to the antenna module 160.

As shown in FIG. 1, an entire shape of the internal case 190 may be similar to that of the external case 180. Specifically, in order to use as a radiator of the antenna module 160, a slot 191 is formed in the internal case 190. Particularly, referring to FIG. 1, the slot 191 is positioned at a location (i.e., a lower portion of the slot 181) corresponding to the slot 181 of the external case 180. The antenna module 160 is electrically connected (or coupled) to the external case 180 and the internal case 190 to radiate electric waves in a rear direction through the slots 181 and 191.

A non-metal material is filled in the slot 191 of the internal case 190. That is, the internal case 190 includes a metal portion 192 in which the slot 191 is formed and a non-metal portion 193 installed in the slot 191.

The non-metal portion 193 is formed by injection molding, for example plastic to correspond to a shape of the slot 191. A material of the non-metal portion 193 is not limited to a specific non-metal and may be made of any material through which electric waves may pass. Further, a method of manufacturing the non-metal portion 193 is not limited to injection molding.

Referring to FIG. 1, the antenna module 160 is coupled to the circuit board 140. The antenna module 160 is installed under the slot 191 of the internal case 190. The antenna module 160 is electrically connected (or coupled) to the circuit board 140, radiates electric waves according to the control of a controller mounted in the circuit board 140, changes received electric waves into an electrical signal, and transfers the electrical signal to the circuit board 140. Here, at a front surface of the circuit board 140, a Central Processing Unit (CPU) for controlling the mobile terminal 100, a memory for storing various data and programs, and a Power Management Unit (PMU) for managing power of the battery 150 may be installed. As shown in FIG. 1, the battery 150 is positioned at a rear surface of the circuit board 140. The circuit board 140 is generally mounted within the mobile terminal 100 and may be implemented as one of a Printed Circuit Board (PCB), a Printed Board Assembly (PBA), etc.

The antenna module 160 includes a body 161, a connector 162, a power supply pattern 163, and a radiation pattern 164. The connector 162 connects an external device and the mobile terminal 100, i.e., the circuit board 140. The connector 162, which may be, for example, a Universal Serial Bus (USB) connector, is electrically connected to the circuit board 140 and is protruded from the antenna module 160, as shown in FIG. 1. Such a connector 162 is exposed to the outside through holes 184 and 194 formed at an edge of the external case 180 and the internal case 190.

The body 161 of the antenna module 160 may be an insulating material, and a wire for electrically connecting the power supply pattern 163 and the radiation pattern 164 to the circuit board 140 may be formed. The body 161 may be made of any of various materials, for example an epoxy resin, or combination of materials. As shown in FIGS. 2 and 3, the power supply pattern 163 and the radiation pattern 164 are formed on the same line, for example, at a front surface of the body 161. Further, as shown in FIG. 5, the power supply pattern 163 may be formed at a relatively lower position than that of the radiation pattern 164. For example, the power supply pattern 163 may be formed at a rear surface of the body 161, and the radiation pattern 164 may be formed at a front surface of the body 161.

The power supply pattern 163 and the radiation pattern 164 may be made of a metal material, for example, copper. The power supply pattern 163 and the radiation pattern 164 may be formed by attaching a copper foil to the front surface of the body 161 and patterning with a photolithography process. A method of forming the patterns 163 and 164 is not limited thereto.

As shown FIG. 5, the radiation pattern 164 is electrically connected (or coupled) to the rear case 170, the rear case 170 is electrically connected (or coupled) to a ground portion 141 of the circuit board 140, and the power supply pattern 163 is electrically connected (or coupled) to a power supply portion 142 of the circuit board 140. When a current is supplied from the circuit board 140 to the power supply pattern 163 through the ground portion 141 according to such a connection (or coupling) configuration, a coupling effect occurs between the power supply pattern 163 and the radiation pattern 164, and therefore a multi-band of electric waves are radiated through the radiation pattern 164.

For example, a separation distance between the power supply pattern 163 and the radiation pattern 164 may be 1 mm, and electric waves of a 900 MHz band and electric waves of a 1.55 GHz band may be radiated according to such a separation distance. Here, a frequency band to be radiated may be different according to a shape and a size of the patterns 163 and 164 as well as a separation distance. Further, the slot is formed in the rear case 170 according to the present exemplary embodiment, and the slot electrically connects (or couples) the radiation pattern 164 and the ground portion 141. Therefore, the rear case 170 is used as another radiator of the antenna module 160 and performs a function of radiating electric waves. That is, the rear case 170 resonates in a specific frequency band, for example 900 MHz and 1.55 GHz by electric charges formed at a periphery of the slot.

The front case 110 forms an external form of the mobile terminal together with the touch screen panel 120 and the rear case 170. The front case 110 protects internal constituent elements from an external impact. The front case 110 may be made of a metal or a non-metal. However, in order to radiate electric waves in the front direction A, it is preferable that an area 111 (hereinafter, a radiation area)

positioned at a lower portion of the antenna module 160 in the front case 110 is made of a non-metal material.

Although not shown in the drawings, a hard key may be installed in a radiation area 111. Such a hard key may be made of a metal material and thus may disturb radiation of electric waves. In a mobile terminal in which a hard key is installed in the radiation area 111, the radiation pattern 164 may be positioned at a location in which a hard key is not installed. For example, when the hard key is installed at the center of the radiation area 111, the radiation pattern 164 may be installed at the left side or the right side, except for the center at a front surface of the body 161. In a mobile terminal in which a hard key is not installed in the radiation area 111, a shape, size, and installation position of the radiation pattern 164 are free.

In FIGS. 1 to 5, the rear case 170 is formed in two cases of the external case 180 and the internal case 190. However, a structure of the rear case 170 is not limited thereto and may be formed in one case. In a mobile terminal having one rear case according to the present exemplary embodiment, when the rear case is separated from the mobile terminal, a radiator (i.e., the rear case) is not present and thus a radiation performance of the antenna is relatively deteriorated or a radiation performance of an antenna cannot be secured, compared with when a rear case is present.

In a mobile terminal in which a rear case is two cases of an external case and an internal case, even if the external case is removed, the internal case still functions as a radiator and thus a radiation performance of the antenna can be maintained. For example, in order to replace a battery, the external case may be separated from the mobile terminal.

In FIGS. 1 to 5, an entire shape of the internal case 190 is similar to that of the external case 180. However, the entire shape of the internal case 190 is not limited thereto and may have various shapes. Several examples are described with reference to FIGS. 6 to 12

Figure 6:
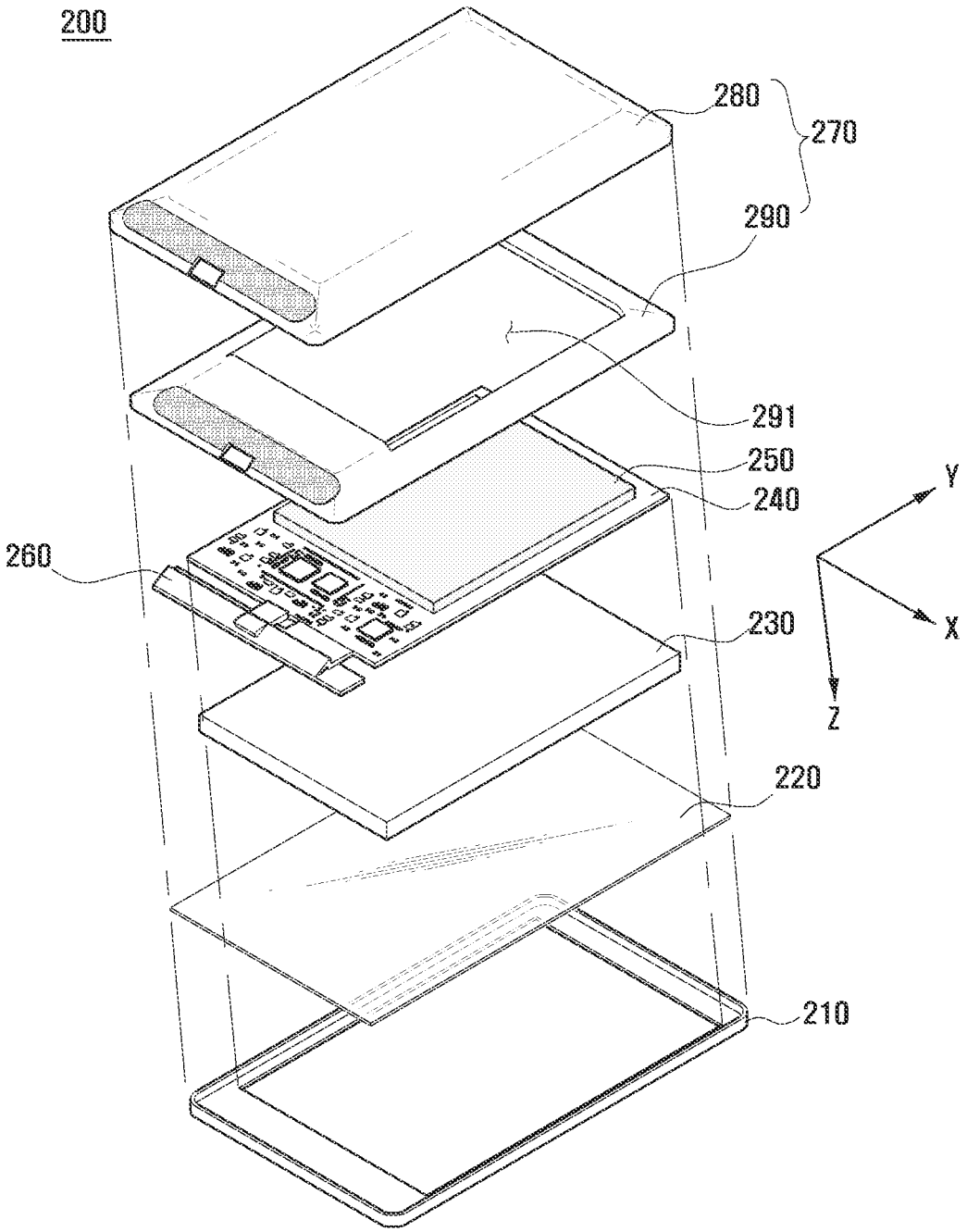
FIG. 6 is an exploded perspective view illustrating a mobile terminal according to another exemplary embodiment of the present invention.
Figure 7:
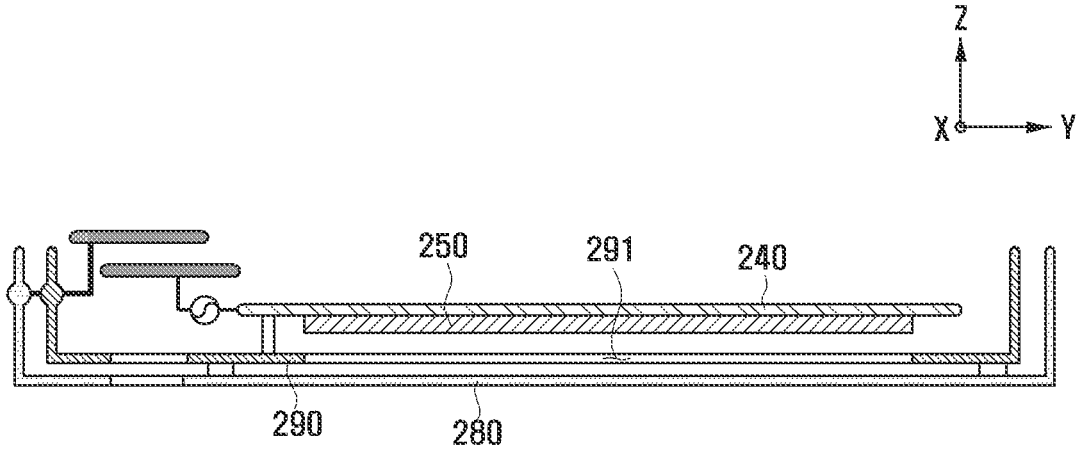
FIG. 7 is a cross-sectional view illustrating the mobile terminal of FIG. 6 according to an exemplary embodiment of the present invention.

FIG. 6 is an exploded perspective view illustrating a mobile terminal according to another exemplary embodiment of the present invention. FIG. 7 is a cross-sectional view illustrating a mobile terminal according to another exemplary embodiment of the present invention.

Referring to FIGS. 6 and 7, a mobile terminal 200 according to another exemplary embodiment of the present invention includes a front case 210, a touch screen panel 220, a display panel 230, a circuit board 240, a battery 250, an antenna module 260, and a rear case 270 including an external case 280 and an internal case 290.

In order to replace the battery 250, the external case 280 may be separated from the mobile terminal 200 and may be recoupled to the mobile terminal 200. The internal case 290 may have a structure that cannot be easily separated from the mobile terminal 200 by a user. For example, the internal case 290 may be coupled to the mobile terminal 200 by at least one of a screw, retaining tabs, and glue. In order to remove the battery 250 from the inside of the mobile terminal 200 and to insert the battery 250 into the mobile terminal 200, a battery groove 291 may be formed in the internal case 290. The remaining constituent elements, except for the battery groove 291 formed in the internal case 290, are substantially the same as the constituent elements described with reference to FIGS. 1 to 5 and therefore a detailed description thereof will be omitted herein.

In the mobile terminal 200 of FIGS. 6 and 7, even if the external case 280 is removed, the internal case 290 still functions as a radiator and thus a radiation performance of the antenna can be maintained.

For example, in order to replace the battery 250, the external case 280 may be separated from the mobile terminal 200. That is, even in a situation in which the external case 280 is separated from the mobile terminal 200, the internal case 290 may be an auxiliary means of the external case 280 for continuing to maintain a radiation performance of the antenna.

Figure 8:
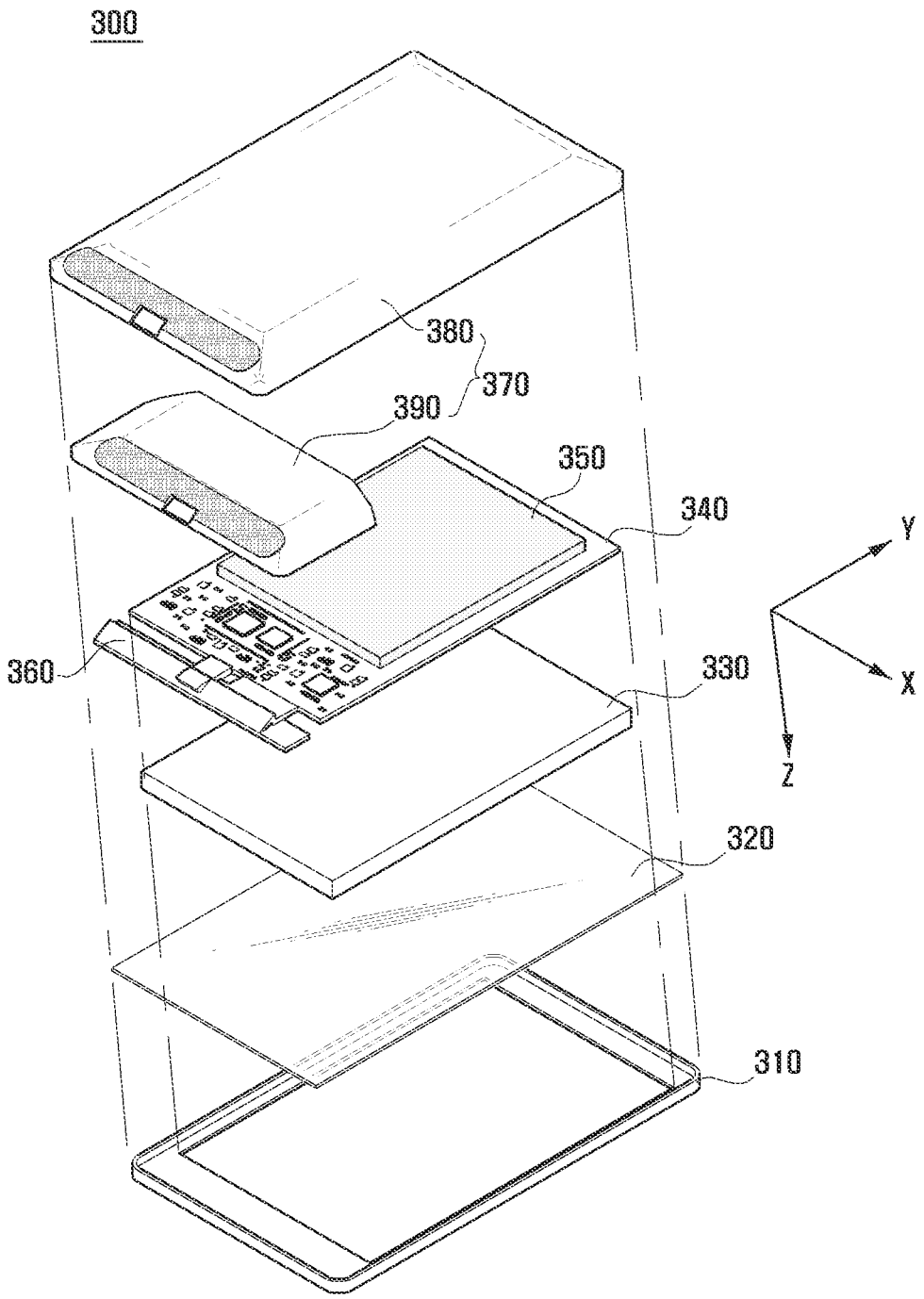
FIG. 8 is an exploded perspective view illustrating a mobile terminal according to another exemplary embodiment of the present invention.
Figure 9:
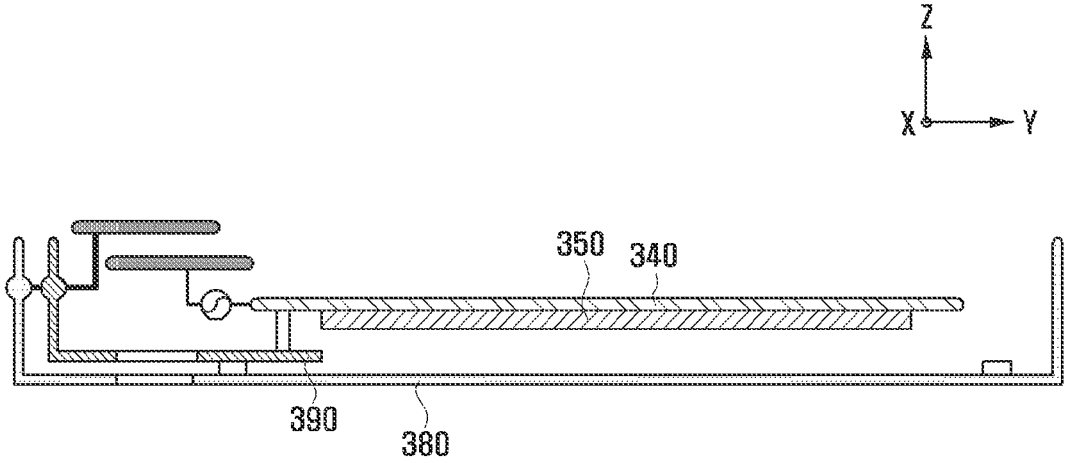
FIG. 9 is a cross-sectional view illustrating the mobile terminal of FIG. 8 according to an exemplary embodiment of the present invention.

FIG. 8 is an exploded perspective view illustrating a mobile terminal according to an exemplary embodiment of the present invention. FIG. 9 is a cross-sectional view illustrating the mobile terminal of FIG. 8.

Referring to FIGS. 8 and 9, a mobile terminal 300 according to another exemplary embodiment of the present invention includes a front case 310, a touch screen panel 320, a display panel 330, a circuit board 340, a battery 350, an antenna module 360, and a rear case 370 including an external case 380 and an internal case 390.

In order to replace the battery 350, the external case 380 may be separated from the mobile terminal 300 and may be recoupled to the mobile terminal 300. The internal case 390 may have a structure that cannot be easily separated from the mobile terminal 300 by a user. In order to remove the battery 350 from the inside of the mobile terminal 300 and to insert the battery 350 into the mobile terminal 300, the internal case 390 may have a structure that does not cover the battery 350. The remaining constituent elements, except for a shape of the internal case 390 are the same as constituent elements described with reference to FIGS. 1 to 5 and therefore a detailed description thereof will be omitted herein. Even if the external case 380 is removed from the mobile terminal 300 of FIGS. 8 and 9, the internal case 390 still functions a radiator and thus a radiation performance of the antenna can be maintained.

Figure 10:
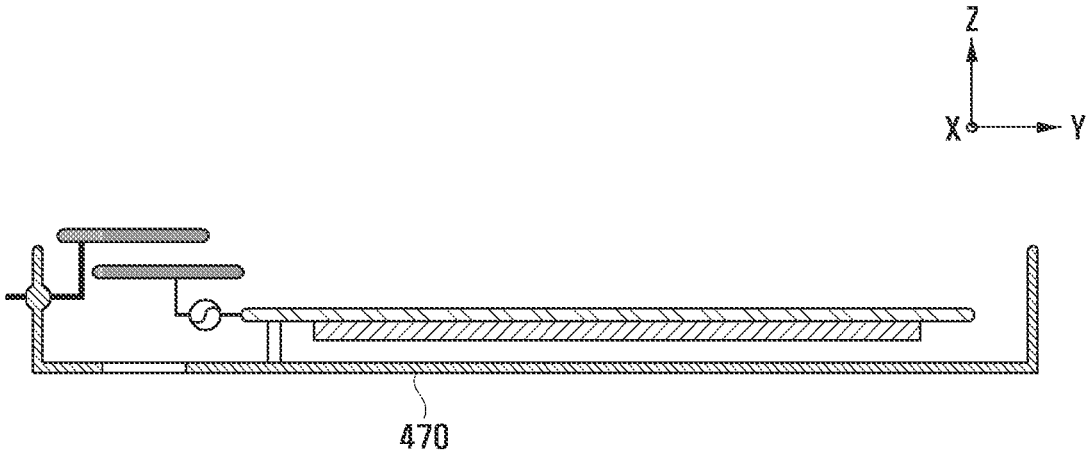
FIGS. 10 to 12 are cross-sectional views of a mobile terminal additionally illustrating various examples of a rear case according to an exemplary embodiment of the present invention.
Figure 11:
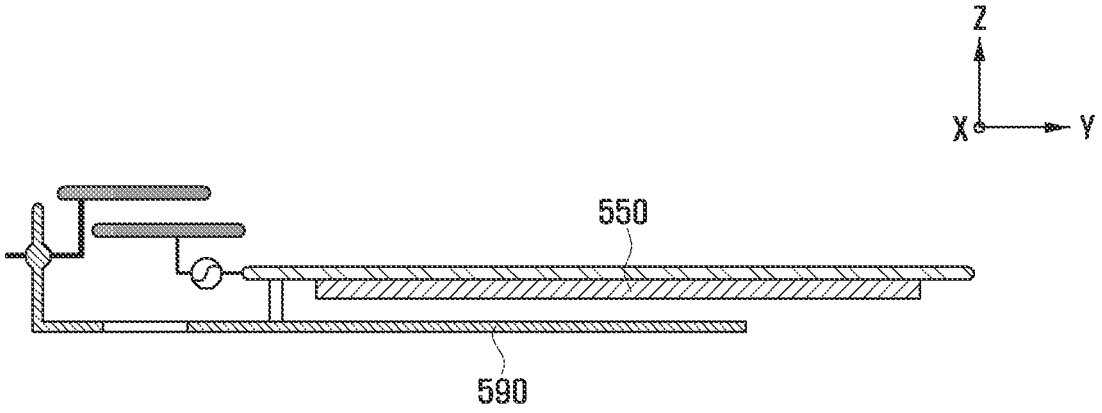
Figure 12:
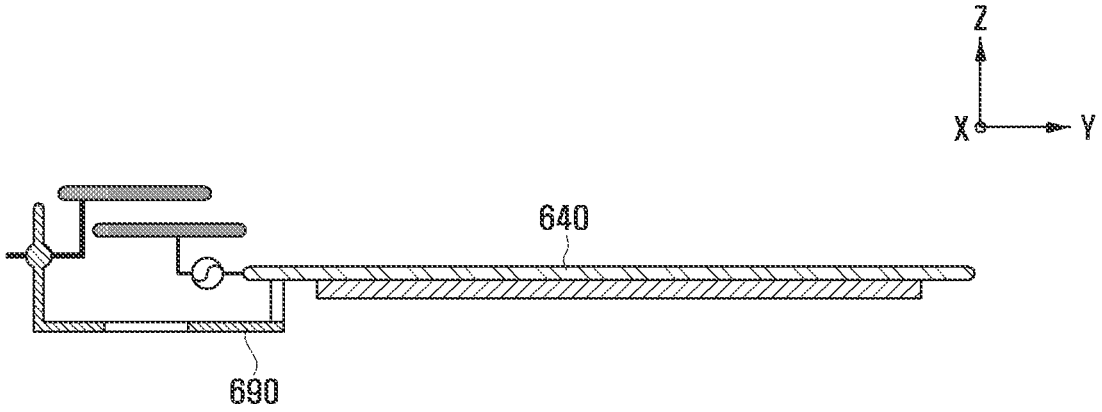

FIGS. 10 to 12 are cross-sectional views of a mobile terminal additionally illustrating various examples of a rear case according to an exemplary embodiment of the present invention.

Referring to FIG. 10, a rear case 470 may be formed as one case without division of an internal case/an external case. In this way, when the rear case 470 is one case, the rear case 470 may be applied to, for example a mobile terminal having a built-in battery for which there is not a need to separate a case.

Referring to FIG. 11, an internal case 590 of a rear case may have a structure that covers a portion of the battery 550. Referring to FIG. 12, an internal case 690 of the rear case may have a structure that does not cover a circuit board 640.

Figure 13:
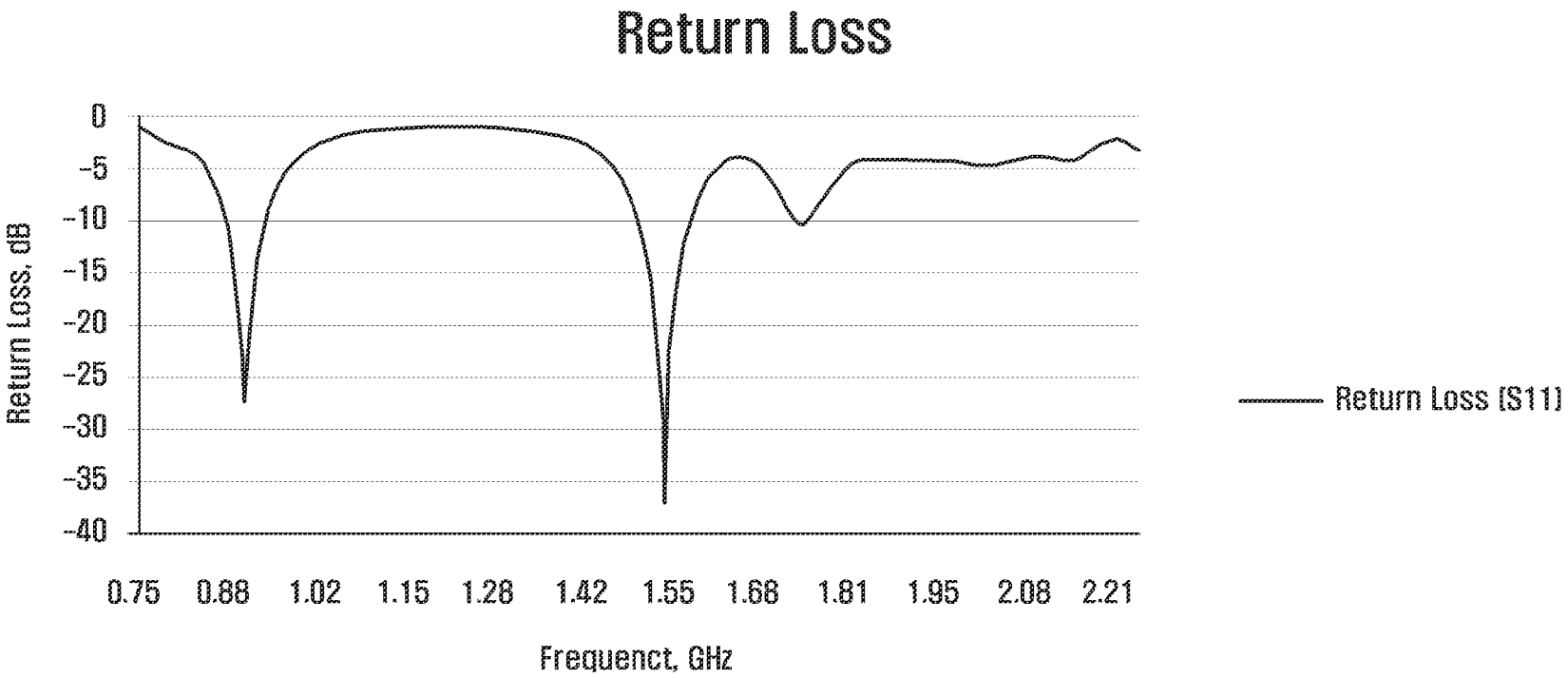
FIGS. 13 and 14 are graphs illustrating a radiation performance of a mobile terminal according to an exemplary embodiment of the present invention.
Figure 14:
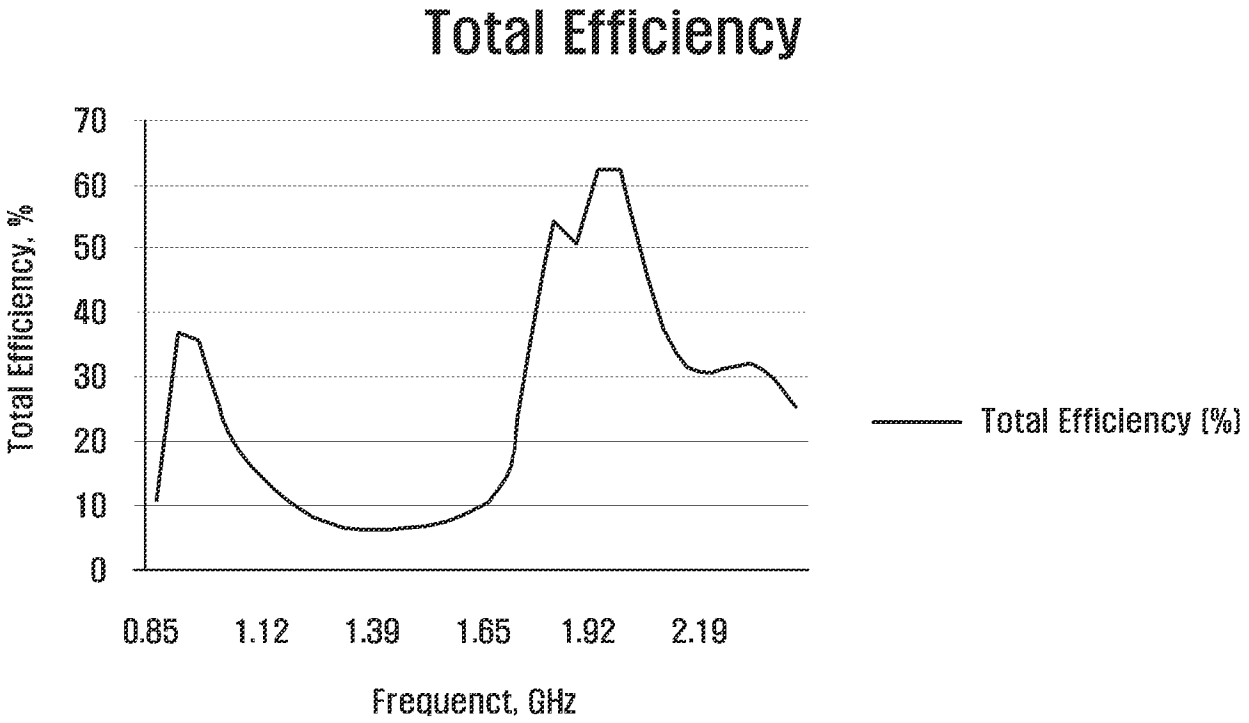

FIGS. 13 and 14 are graphs illustrating a radiation performance of a mobile terminal according to an exemplary embodiment of the present invention.

When a mobile terminal includes a rear case that is constructed using a metal material, in order to radiate electric waves, the rear case constructed using the metal material has a slot, and the slot is electrically connected (or coupled) to a radiation pattern of an antenna module housed in the mobile terminal. That is, the rear case constructed using the metal material has a slot at the inside, and the slot is electrically connected (or coupled) to each of a radiation pattern and the ground of the mobile terminal and thus the rear case performs the same operation as that of a monopole antenna of one radiator.

A monopole antenna is an antenna having one side grounded, unlike a dipole antenna using both poles. Such a monopole antenna represents a characteristic like a dipole antenna, as an image effect occurs in a grounded portion. When a current is supplied to a power supply pattern of an antenna module, a coupling effect occurs between the power supply pattern and the radiation pattern. The radiation pattern grounded to the rear case of a metal material forms a resonance in a low frequency band and a high frequency band according to a coupling effect.

Referring to FIG. 13, for example, a low frequency band is a frequency band having a reflection coefficient of −5 dB or low and may be 900 MHz band. A high frequency band having a reflection coefficient of −5 dB or low may be 1.55 GHz band.

Referring to FIG. 14, as a performance result of a simulation, in a low frequency band, efficiency of a radiation performance is 35%, and in a high frequency band, efficiency of a radiation performance is 55%. As described above, a rear case is constructed using a metal material and may include an external case and an internal case in which a slot is formed in a portion of a metal material. For example, when the rear case is formed with two cases including an internal case and an external case, the rear case shows efficiency of the same radiation performance. Further, even when the external case is removed, the rear case shows efficiency of the same radiation performance.

In the foregoing description, when an entire material of the case is metal, a mobile terminal according to an exemplary embodiment of the present invention can still be used. In general, when a metal case is used with a mobile terminal, it is difficult to secure a radiation performance of an antenna. According to an exemplary embodiment of the present invention, a slot is formed in the metal case, and a radiation pattern of an antenna module is grounded to such a metal case. Therefore, the metal case performs an intrinsic function (i.e., protection of internal constituent elements) and operates as a radiator.

A mobile terminal according to an exemplary embodiment of the present invention may be any device having a case constructed using a metal material. For example, the mobile terminal may be a mobile phone, a smart phone, a Portable Multimedia Player (PMP), a digital broadcasting player, a Personal Digital Assistant (PDA), a Music Player (e.g., MP3 player), a mobile game terminal, a tablet Personal Computer (PC), and a laptop PC.

For example, it is described that in a rear case, an external case is made of a metal material, and a slot is formed in the metal material. However, because the internal case operates as a radiator, the external case may be, for example, a product injection-molded with plastic. This is, the external case may be made of a non-metal material.

As described above, according to an exemplary embodiment of the present invention, in a mobile terminal including a metal case that is used as a radiator, a radiation performance of an antenna can be secured.

While the invention has been shown and described with reference to certain exemplary embodiments thereof, it will be understood by those skilled in the art that various changes in form and details may be made therein without departing from the spirit and scope of the of the invention as defined by the appended claims and their equivalents.

What is claimed is:

1. An antenna device of a mobile terminal, the antenna device comprising:

an antenna module configured to radiate electric waves comprising:

a body, which is an insulation material, and a radiation pattern functioning as a first radiator of electric waves, formed in the body toward a front surface of the mobile terminal to radiate electric waves toward the front surface in which a display screen of the mobile terminal is disposed;

an internal case made of a first metal material, the internal case having a first slot in a portion of the first metal material and having a housing space for housing the antenna module; and an external case comprising a rear case formed at a rear surface of the mobile terminal opposite to the front surface of the mobile terminal in which the display screen of the mobile terminal is disposed, the external case made of a second metal material, having a housing space for housing the internal case, and having a second slot in a portion of the metal material, wherein the second slot is formed in the rear case, in alignment with the first slot of the internal case, and is electrically coupled to each of the radiation pattern of the antenna module and a ground of the mobile terminal such that the rear case is configured to function as a second radiator of electric waves resonating at frequency different of the radiation pattern of the antenna module and in a direction different from that of the radiation pattern of the antenna module.

2. The antenna device of claim 1, wherein the display screen is a touch screen.

3. The antenna device of claim 1, wherein the antenna module is housed in the internal case of the mobile terminal and is housed at a position corresponding to the first slot.

4. The antenna device of claim 1, wherein the antenna module further comprises a power supply pattern for generating a coupling effect with the radiation pattern by supplying a current from a circuit board provided inside the mobile terminal.

5. The antenna device of claim 1, wherein the case comprises the rear case and a front case formed at the front surface, and at the front case, a radiation area corresponding to a position at which the radiation pattern is formed is made of a non-metal material through which electric waves radiate toward the front surface.

6. The antenna device of claim 1, wherein the external case is separable from the mobile terminal, and the internal case is electrically connected to each of the antenna module and the ground of the mobile terminal to operate as a radiator through the first slot.

7. The antenna device of claim 6, wherein, when the external case is separated from the mobile terminal, the internal case includes a structure in which a battery housed in the mobile terminal is separable from the mobile terminal.

8. The antenna device of claim 7, wherein the internal case includes a structure having a groove through which the battery passes when being removed or installed.

9. The antenna device of claim 7, wherein the internal case includes a structure that does not cover the battery.

10. The antenna device of claim 1, wherein the second slot is formed at an edge of the rear case.

11. The antenna device of claim 1, wherein the second slot is filled with a non-metal material.

12. The antenna device of claim 11, wherein the non-metal material has the same color as the metal material.

13. The antenna device of claim 1, wherein a connector, for electrically connecting an external device to a circuit board provided inside the mobile terminal, is exposed to outside the mobile terminal through the second slot.

14. The antenna device of claim 13, wherein the connector is a universal serial bus (USB) connector.

* * * * *